United States Patent [19]

Weick et al.

[11] Patent Number: 4,553,665

[45] Date of Patent: Nov. 19, 1985

[54] REFILLABLE CASE FOR FRESHEN-UP CLOTHS

[76] Inventors: Heinz H. Weick, 94 Rue de la Servette, 1202 Geneve; Walter Hesener, 66 Rue de la Prulay, 1217 Meyrin-Geneve; Rolf Wattinger, Im Isisbuel 6, 8800 Thalwil, all of Switzerland

[21] Appl. No.: 537,383

[22] PCT Filed: Dec. 16, 1982

[86] PCT No.: PCT/CH82/00133

§ 371 Date: Aug. 17, 1983

§ 102(e) Date: Aug. 17, 1983

[87] PCT Pub. No.: WO83/02051

PCT Pub. Date: Jun. 23, 1983

[30] Foreign Application Priority Data

Dec. 17, 1981 [CH] Switzerland ..... 8052/81

[51] Int. Cl.[4] ..... A45D 37/00; A45D 34/00

[52] U.S. Cl. ..... 206/37; 206/210; 206/233; 206/39.7; 206/440; 206/445; 206/494; 206/812

[58] Field of Search ..... 206/37, 205, 210, 233, 206/38, 39.7, 449, 440, 494, 445, 812; 229/17 R, 17 S

[56] References Cited

U.S. PATENT DOCUMENTS

| | | | |
|---|---|---|---|
| 1,274,628 | 8/1918 | Thorp | 206/37 R |
| 1,554,178 | 9/1925 | Sickels | 206/494 |
| 1,658,085 | 2/1928 | Hudson | 206/494 |
| 1,844,468 | 2/1932 | Fischer | 206/494 |
| 1,871,617 | 8/1932 | King | 229/15 |
| 2,219,454 | 10/1940 | Reilly | 206/37 R |
| 2,366,009 | 12/1944 | Pasquale et al. | 206/37 R |
| 2,619,226 | 11/1952 | Adams | 229/17 S |
| 2,689,643 | 9/1954 | Willits | 229/17 R |
| 4,000,816 | 1/1977 | Spruyt | 206/812 |
| 4,131,195 | 12/1978 | Worrell, Sr. | 206/812 |

FOREIGN PATENT DOCUMENTS

| | | | |
|---|---|---|---|
| 1464273 | 2/1977 | United Kingdom | 206/210 |

*Primary Examiner*—William T. Dixson, Jr.
*Assistant Examiner*—Brenda J. Ehrhardt
*Attorney, Agent, or Firm*—Fleit, Jacobson, Cohn & Price

[57] ABSTRACT

The refillable case comprises the bottom shell portion (1) and the cover shell portion (2) which are joined together by a hinge means (3). The shell portions (1, 2) enclose a circular chamber (4) in which are disposed two stacks of freshen-up cloths (6), of substantially square configuration, which are folded into a semicircular form. A retaining member (5) in the form of a plate is disposed centrally in the chamber, approximately at the level of the plane of the chamber opening. Each cloth (6) is so folded and fitted into the chamber (4) that a triangular portion (6g) thereof is on the top. By pulling thereon, the part of the cloth over which the plate (5) extends is rolled out of its cover means, without the secure position of the cloth therebelow being affected.

10 Claims, 10 Drawing Figures

REFILLABLE CASE FOR FRESHEN-UP CLOTHS

TECHNICAL FIELD

Figure 1:
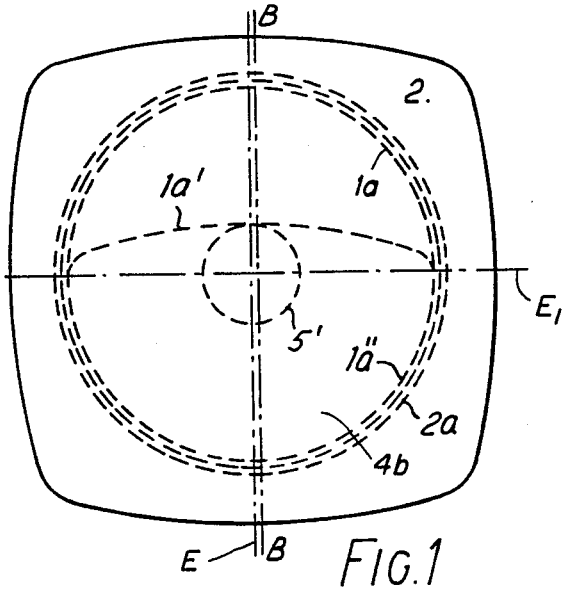

The present invention relates to a refillable case having a shallow chamber for accommodating a plurality of liquid-impregnated, folded freshen-up cloths which are independent of each other, wherein the bottom and the peripheral wall of the chamber are formed by a shallow bottom shell portion, while the chamber is covered over at the top by a shallow cover shell portion which engages over the chamber over the entire area thereof and which, for the purposes of manual removal of a freshen-up cloth, is displaceable from a closure position in which it at least substantially gas-tightly covers over the chamber, into an open position in which the opening of the chamber is exposed.

The further invention relates to a freshen-up cloth of substantially square or rectangular configuration and having two folds which extend normal to each other.

BACKGROUND STATE OF THE ART

Liquid-impregnated freshen-up or freshening cloths are for example packaged individually in aluminum bags. A plurality of such bags is disposed in a box. That kind of packaging suffers from a number of disadvantages. If a number of bags are to be carried on one's person, then either one is faced with the difficulty of accommodating the comparatively large box, a pocket in clothing or a small handbag scarcely having sufficient space for the box, or the box is not used, and that results in the plurality of individual bags being stored in an untidy and confused manner. The amount of material involved in making the individual one-trip packaging means is very great and the operation of opening the bags is not a practical one. In addition, each empty bag should be disposed of in a tidy fashion. The user of such cloths is limited to the perfumes offered, although in most cases they are not the same as the preferred perfume or facial cologne of the user of the cloths.

Swiss patent specification No. 621 932 already proposed that a plurality of independent freshen-up cloths or the like may be gas-tightly accommodated in a refillable case, so that they may be taken out of the case as required. However, such a case suffers from the disadvantage that the cloths can drop out if the case is opened when it is in the wrong position. As a result of the cohesion effect due to the liquid in the cloths, it is difficult for a cloth to be removed easily and conveniently, without also pulling out at least a second cloth. When using cloths which are folded in a conventional manner, further difficulties arise in regard to arranging the cloths within the chamber of the case, in an efficient manner such as to permit the cloths to be easily grasped.

U.S. Pat. No. 3,967,756, U.S. Pat. No. 4,185,754 and French patent specification No. 2 239 972 also disclose accommodating individually cut freshen-up cloths or freshen-up cloths which are in the form of a web of material from which the cloths can be torn off, in containers or bags which are fixedly closed except for a small opening for removing the cloths, so that such containers or bags cannot be refilled. As such an arrangement is a one-trip packaging, the packaging expenditure is comparatively high. Due to the principle on which the cloths are removed, the possible ways of folding the cloths are greatly restricted, so that the containers or bags are of very large area. Due to the principle on which that arrangement operates, the shapes of the bags or containers are inelegant. Such constructions are only of general significance, in relation to the present invention, as they do not directly concern the general kind of packaging means of the present invention.

DISCLOSURE OF THE INVENTION

The present invention is based on the problem of developing a refillable case of the kind set forth in the above-mentioned Swiss patent specification, and freshen-up cloths, for accommodating same in the case, using simple means, while eliminating the disadvantages referred to above in this respect.

The invention in a first aspect provides that, within the plan view outline of the chamber of the refillable case, substantially at the level of the plane of the opening of the chamber, a thin retaining member which covers over part of the area of the chamber, for retaining the freshen-up cloths, is arranged and dimensioned in such a way that a remaining open region of the area of the opening of the chamber extends, at least over a quarter of the periphery of the chamber, substantially as far as the peripheral wall of the chamber.

In accordance with a further invention, starting from a freshen-up cloth of substantially square or rectangular configuration, and with two folds which are disposed on the two mutually normal centre lines and which fold the cloth together to a quarter of its open configuration, it is proposed that a third fold which extends substantially in a diagonal direction through the cloth which is folded to a quarter of its size, is provided in such a way that the areas which are superimposed as a result of the diagonal folding are of different size.

The advantages achieved by the present invention will be apparent from the specific description hereinafter.

Figure 2:
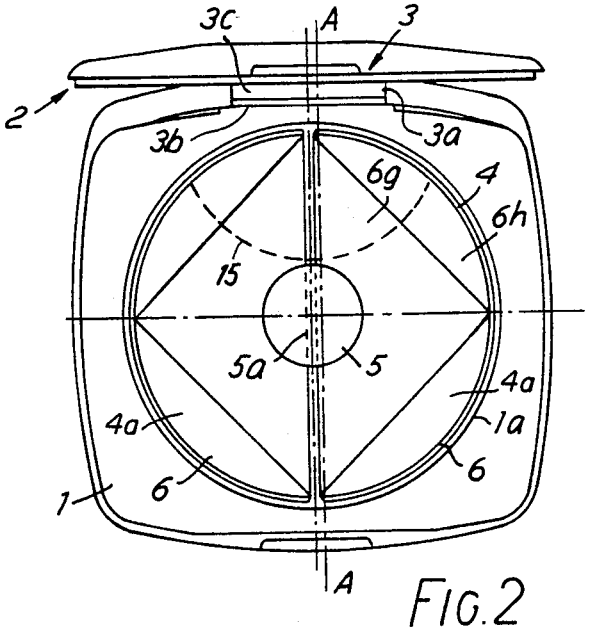
Figure 3:
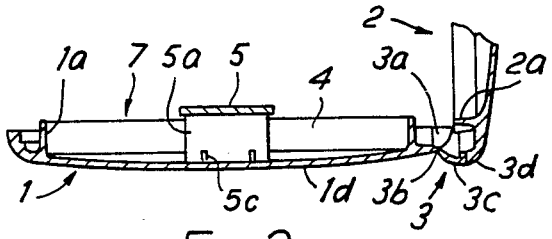
Figure 4:
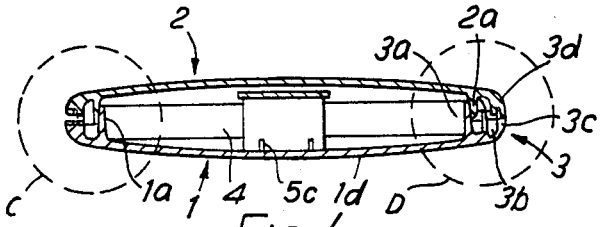
Figure 5:
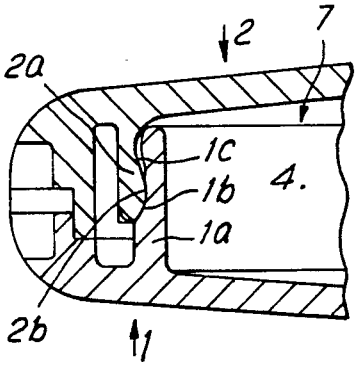
Figure 6:
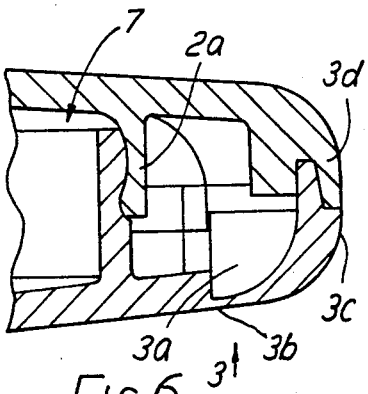

An embodiment of the invention is illustrated in the drawings in which:

FIG. 1 shows a plan view of the case,

FIG. 2 shows a plan view of the case in an open condition, with the cover in a perpendicular position, FIG. 3 shows a view in section taken along line A—A in FIG. 2, FIG. 4 shows a view in section taken along line B—B in FIG. 1, FIG. 5 shows the region C in FIG. 4 on an enlarged scale, FIG. 6 shows the region D in FIG. 4 on an enlarged scale, and FIGS. *7a* to *7d* show the configuration of a freshen-up cloth and the various folded conditions thereof.

A refillable case (hereinafter referred to simply as the case) comprises a substantially flat, shallow bottom shell portion 1 and a substantially flat, shallow, cover shell portion 2 which are joined together by a hinge means 3. Formed or moulded on the bottom shell portion 1, on the inside thereof, is an annular curved peripheral wall 1*a* which encloses a chamber 4. In order sealingly to cover over the chamber, the cover shell portion 1 is also provided on its inside with an annular cover shell wall 2*a* which, in the closed condition of the case, closely encloses the peripheral wall 1*a* on the outside thereof, with an annular groove 1*b* and an annular projection 2*b* additionally engaging sealingly one into the other. At least one of the two walls 1*a* and 2*a* has a certain degree of inherent elasticity for that purpose.

A hinge means 3 includes a U-shaped recess 3*a* having two spaced end walls and which is formed or moulded on the bottom shell portion 1 in the peripheral region thereof. The recess end walls are arranged at the same spacing from, and on both sides of, a bottom shell centre line E parallel thereto. A film hinge flap is injection moulded on the bottom surface of the recess 3*a*, approximately in the region of the surface of the bottom shell portion 1. The film hinge flat has a strip-like root portion 3*b* attached to the bottom shell 1 and extends into a curved limb or web portion 3*c* which engages at its reduced end flange region 3*d* into a slot-like opening in the cover shell portion 2, where it is secured by adhesive means or ultrasonic welding. By virtue of that construction, the hinge axis which co-incides with the film hinge 3*b* is displaced to a lower position than the plane of contact of the bottom shell portion 1 and the cover shell portion 2. This arrangement provides that the annular peripheral wall 2*a* of the cover shell portion 2 can engage precisely over the peripheral wall 1*a* of the bottom shell portion 1 during the movement of closing the cover of the case, without those walls striking against each other at the beginning of the closing movement, which would interfere with proper interengagement of the walls. The limb portion or hinge flap 3*c* of the hinge means is of such a size and curvature that, when the case is in a closed condition, the limb portion 3*c* engages precisely into the recess or opening 3*a* so that there is no hinge projection, that is to say, the bottom shell portion configuration is maintained at that point. As a result of the film hinge being formed or moulded directly on the case, there are no hinge bores or holes and therefore no delicate side slide members in the moulding tool.

Disposed centrally in the chamber 4 is a retaining member which is in the form of a plate 5, for securing in position the freshen-up cloths which are denoted by 6 and which are referred to hereinafter simply as cloths. The plate 5 is disposed substantially in the plane of the opening of the chamber 4 and has a web-like base or leg portion 5*a* which is formed or moulded on the underside thereof in an umbrella- or mushroom-like configuration. The portion 5 is secured to the bottom shell portion 1 on the inside thereof, by adhesive means or by ultrasonic welding. Conical projections 5*c* which are formed or moulded on the bottom shell portion 1 serve to facilitate positioning of that arrangement. It is also possible for the base portion 5*a* to be formed or moulded on the bottom shell portion 1 and for the plate 5 to be secured at the top thereof by adhesive means or by ultrasonic welding. Thus the plate 5 engages over the two semi-circular portions 4*a* (see FIG. 2) of the chamber 4, from the portion 5 or from the centre line E. The remaining open region of the area of the opening 7 of the chamber is indicated at 7*a*.

Figure 7A:
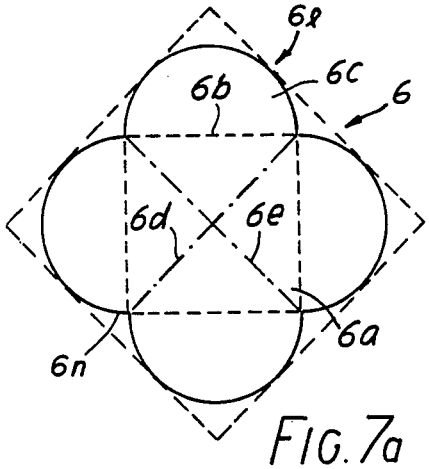

The cloths 6 are of the configuration illustrated in FIG. 7*a*, of a square basic shape as indicated at 6*l*. It has a central region 6*a* which is also square, with semicircular flaps or tabs 6*c* adjoining each of the four sides 6*b* of the central square region.

Figure 7B:
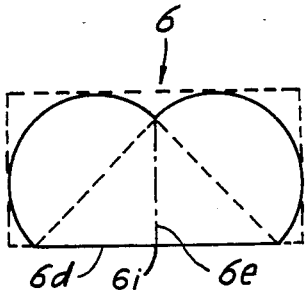
Figure 7C:
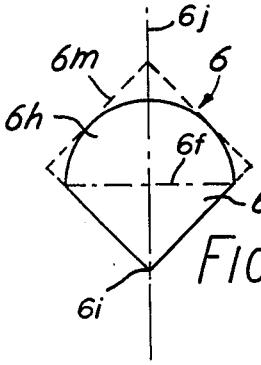
Figure 7D:
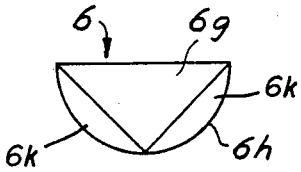

The configuration shown in FIG. 7*b* is produced by a first fold on the centre line 6*d* of the basic outline configuration 6*l*. If the cloth is now folded for a second time on the second centre line 6*e*, (both folds also pass through the contact points 6*n* of the semicircular portion 6*c*) the cloth is then in the form shown in FIG. 7*c*. By means of a third fold on the line 6*f* which is in a diagonal direction (in relation to the square basic configuration indicated at 6*m*), the triangular portion 6*g* is folded over against the semicircular portion 6*h*. The line 6*f* extends in the diagonal direction and transversely with respect to the centre line 6*j* which passes through the point of intersection 6*i* of the first two folds 6*d*, 6*e*. This gives the final form shown in FIG. 7*d* in which the edge portions 6*k* of the portion 6*h* project over the region 6*g*. A flexible refillable package contains one or two stacks of for example six cloths which are folded in the above-indicated manner (either dry or liquid-impregnated). The cloths are introduced into the chamber 4 in the bottom shell portion 1 as required, in the manner shown in FIG. 2, that is to say, the triangular portions 6*f* are at the top. By virtue of both stacks having the plate 5 engaging thereover, the cloths are prevented from dropping out even when by mistake the case is held in such a position, upon being opened, that the bottom shell portion 1 is on the top. The triangular portions 6*g* facilitate grasping the cloths and ensure that only one cloth is ever gripped at a time. By virtue of pulling on the outer tip or corner of a triangular region, the part of the cloth which has the plate 5 extending thereover rolls out of the cover arrangement formed by the plate 5 extending thereover, without the secure position of the cloth below the cloth being pulled out being affected. The underneath cloth is also not touched so that the cloths which remain in the case remain clean, even when a cloth is removed with dirty fingers.

As, when the case is closed, the chamber 4 is not sealed off only in the actual final closed position of the cover, the air which is compressed in the chamber 4 in that situation can result in a counter-pressure so that the cover shell portion 2 does not move into its definitive closed position or will spring back somewhat. In order to prevent that from happening, a vent passage 1*c* is provided in the peripheral wall 1*a*, substantially opposite to the hinge means 3*a*. The vent passage 1*c* is not fully as long as the mutual interengagement of the two walls 1*a* and 2*a*. By virtue of that arrangement, the sealing effect is produced at that location only shortly before the cover shell portion 1 moves into its final closed position so that compression of the air in the chamber is only so minimal that it can no longer push the two shell portions 1 and 2 apart.

As an alternative to the embodiment illustrated, the plate 5 could also be disposed in the vicinity of the periphery of the chamber 4 (as shown in broken lines in FIG. 2 and indicated at 15). It is also possible for the cloth 6 of the general configuration shown in FIG. 7*a* to be folded into a quarter-circular form. For that purpose, the shape shown in FIG. 7*d* would have to be symmetrically folded over once again. Four stacks of such a shape could then be accommodated in the chamber 4, which stacks would all be secured in position by the central plate 5, or only one stack could be accommodated in a chamber of correspondingly small area. In the latter case, it is sufficient for the remaining opening 7*a* of the chamber to extend as far as the peripheral wall of the chamber, only over about a quarter of the periphery of the chamber.

Although the illustrated circular shape in respect of the chamber 4 is to be preferred for reasons concerned with the sealing process thereof, it would be possible for the chamber to be of an angular or cornered configuration, for example square or rectangular, with the cloths being folded together to correspond to the full area of the chamber or an integral fraction thereof and also secured in position in the manner described. In that case, it would of course be recommended that the chamber formed in that manner be sealed by the insertion of a sealing ring.

Within the chamber, the cloths which are stacked one beside the other can be separated from each other by ribs formed on the bottom shell portion.

Except for the hinge region, the annular walls 1*a* and 2*a* can also form the outer side walls of the bottom and cover shell portions, whereby the case would be of smaller area and, in the case of having a round chamber 4, would be of a round basic configuration with an outwardly projecting hinge region.

If the chamber has a square or rectangular configuration in plan, there is no need to cut the semicircular flaps or tabs 6*c* on the square basic configuration 6*k* of the cloths. That would mean that the portion or area 6*h* shown in FIG. 7*d* would also become a right-angled triangle, with its edges projecting beyond the area or portion 6*g*.

The case may be further substantially reduced in size by the chamber being of approximately semicircular configuration in plan. In that case however, for reasons concerned with sealing the case, the semicircular arc of the peripheral wall should not be closed in a straight configuration but, as shown in broken line in FIG. 1 and indicated at 1*a*', in a slightly curved configuration. A chamber of such a configuration could accommodate either one stack of cloths 6 which are folded in the manner shown in FIGS. 7*a* to 7*d*, or two stacks of cloths which have been folded in half once again.

The retaining member may also comprise or be formed from resilient sheet metal or metal wire, in for example an elongate configuration.

We claim:

1. A refillable case for a plurality of liquid-impregnated, mutually independent, folded freshen-up cloths, the case having a shallow chamber for accommodating the cloths and comprising: a substantially flat shallow bottom shell having an interior curved peripheral upstanding wall defining an interior chamber having an opening; a substantially flat shallow cover shell engageable with the bottom shell to overlie the chamber over its entire area, the cover shell including an interior curved depending peripheral wall engageable with the peripheral wall in the bottom shell and being displaceable from a closed position in which it at least substantially gas-tightly closes the chamber, into an open position in which the opening of the chamber is exposed; a flat retaining member for retaining the freshen-up cloths and disposed within the plan outline of the chamber and lying substantially in the plane of the edge of the opening of the chamber, the retaining member overlying a portion of the area of the chamber and carried on a stem secured to the inner surface of the bottom shell, the retaining member extending substantially diametrically across the chamber and projecting for part of its area over at least a substantially half-round region of the plan outline of the chamber.

2. A case according to claim 1, in which the chamber is of circular contour in plan and in which the retaining member is in the form of a small plate portion that is arranged in the central region of the chamber and extends outwardly from the stem for part of its area over two semicircular regions of the plan outline of the chamber.

3. A case according to claim 1, in which the retaining member extends inwardly from the peripheral wall of the chamber over part of the area of the chamber.

4. A case according to claim 3, in which the periphery of the chamber is in the shape of an oval which is severely flattened off at one side and which, on the side opposite to its flattened peripheral region extends substantially in the form of a semicircular arc, and in which, from the flattened region of the periphery of the chamber, the retaining member extends for part of its area over the region of the chamber which is defined by the substantially semicircular arc.

5. A case according to claim 1, in which surfaces of the peripheral walls of the bottom shell and cover shell each include annular, interengaging portions that face each other when the case is in the closed condition and bear sealingly against each other.

6. A case according to claim 5, including a vent passage formed in a surface of one of the facing peripheral walls, said vent passage extending from the edge of said surface and being smaller than the dimension of the mutual overlap defined by the interengaging portions of the two peripheral walls.

7. A case according to claim 1, wherein the cover shell is pivotally secured to the bottom shell by a hinge means including a U-shaped recess extending from the outer edge of the bottom shell with two end walls disposed at the same spacing on both sides of a bottom shell centre line and which are directed substantially parallel to said centre line, and a hinge flap on the bottom shell, the hinge flap positioned between the end walls of the recess, and attached to the bottom shell by a strip-like root portion, and being of a flexible thin construction to form a film hinge, and which is fixed to the cover shell in the manner of a flange-groove connection with its outer edge opposite to the root portion.

8. A freshen-up cloth of substantially rectangular configuration adapted to be folded and carried in a case, said cloth comprising: first fold lines which are disposed on two centre lines which extend normal to each other and parallel to peripheral sides of the cloth contour, said cloth when folded along each of said fold lines forming a folded cloth having a quarter of its original area, a further fold line which extends substantially in a diagonal direction of the folded cloth and transversely to a centre line which passes through the point of intersection of the first fold lines, and wherein the cloth is folded along the further fold line and in the final condition of the freshen-up cloth, a larger region thereof projects, as viewed in plan, with its edge regions over a smaller region of the cloth.

9. A cloth according to claim 8, having a square central region which is adjoined at the four sides thereof by respective outwardly extending semicircular flaps whose diameter corresponds to the length of the side of the square, said cloth configuration being folded together by three successively formed folds along the fold lines to provide a folded cloth having a semicircular shape with an overlying triangular region on one side thereof, wherein the first two folds are disposed on the two centre lines of the blank which extend normal to each other and which pass through the points of contact of the semicircles, and the third fold is provided on the separating line between the semicircular portion and the triangular region of the form produced by the second fold.

10. A refillable case in combination with one or more liquid-impregnated mutually independent cloths for freshening up or the like, said case comprising: a shallow chamber having a substantially flat bottom wall for accommodating said cloths, the chamber including a bottom wall and a curved peripheral wall formed in a substantially flat, shallow, bottom shell, a substantially flat, shallow, cover shell engageable over the chamber over the entire area thereof and having a peripheral wall that is displaceable from its basic position in which it at least approximately gas-tightly closes the chamber, into an open position exposing an opening of the chamber, a flat retaining member for retaining the freshening cloths within the chamber, which is positioned approximately in a plane defined by the edge of the opening of the chamber and which is carried on a stem portion which is fixed on the bottom of the chamber, the retaining member extending approximately diametrically through the chamber and projecting over part of its area over at least a substantially half-round region of the plan contour of the chamber; and wherein the freshening cloth has a substantially rectangular contour, two fold lines which are disposed on two centre lines which extend normal to each other and parallel to the peripheral slides of the contour, the folds folding the cloth together to a quarter of its original area; a third fold taken substantially in the diagonal direction and transversely with respect to the centre line of the cloth which is folded to quarter size, said centre line passing through the point of intersection of the two first folds, and a folded end form wherein a larger region of the cloth projects, as viewed in plan, with edge regions over a small triangular region of the cloth and, in the position in which it is placed in the case, engages under the retaining member with a straight-edge region of the cloth.

* * * * *